US006736221B2

(12) United States Patent
Chia et al.

(10) Patent No.: US 6,736,221 B2
(45) Date of Patent: May 18, 2004

(54) METHOD FOR ESTIMATING A POSITION OF A WELLBORE

(75) Inventors: Christopher R. Chia, Houston, TX (US); Wayne J. Phillips, Houston, TX (US); Darren Lee Aklestad, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/028,864

(22) Filed: Dec. 21, 2001

(65) Prior Publication Data

US 2003/0121657 A1 Jul. 3, 2003

(51) Int. Cl.[7] ..... E21B 47/00
(52) U.S. Cl. ..... 175/45; 33/303
(58) Field of Search ..... 175/45; 73/152.03; 33/302, 303, 304, 313; 702/6, 9, 10

(56) References Cited

U.S. PATENT DOCUMENTS

| | | | | |
|---|---|---|---|---|
| 4,454,756 A | | 6/1984 | Sharp et al. | |
| 5,331,578 A | * | 7/1994 | Stieler | 33/313 |
| 5,435,069 A | * | 7/1995 | Nicholson | 33/304 |
| 5,452,518 A | | 9/1995 | DiPersio | |
| 5,646,611 A | | 7/1997 | Dailey et al. | |
| 6,026,914 A | | 2/2000 | Adams et al. | |
| 6,038,513 A | * | 3/2000 | Varsamis et al. | 702/6 |
| 6,065,219 A | * | 5/2000 | Murphey et al. | 33/302 |
| 6,179,067 B1 | | 1/2001 | Brooks | |
| 6,302,204 B1 | | 10/2001 | Reimers et al. | |

FOREIGN PATENT DOCUMENTS

GB 2205166 A 11/1988

OTHER PUBLICATIONS

H.S. Williamson, *Accuracy Prediction for Directional Measurement While Drilling*, SPE Drill. & Completion, vol. 15, No. 4, Dec. 2000, pp. 221–233.

Hugh S. Williamson, *Accuracy Prediction for Directional MWD*, SPE 56702, presented at the SPE Annual Technical Conference, Oct. 1999.

Chris J.M. Wolff, John P. de Wardt, Borehole Position Uncertainty–Analysis of Measuring Methods and Derivation of Systematic Error Model, SPE 9223 (Rev. Sep. 18, 1981) presented at the SPE 55$^{th}$ Annual Fall Technical Conference Sep. 1980.

Search Report Under Section 17 dated Mar. 26, 2003 for GB0224249.3.

* cited by examiner

*Primary Examiner*—David Bagnell
*Assistant Examiner*—Matthew J Smith
(74) *Attorney, Agent, or Firm*—J.L. Jennie Salazar; Brigitte L. Jeffery; John Ryberg

(57) ABSTRACT

A method is disclosed which utilizes multiple overlapping surveys to estimate a position in a wellbore and related position uncertainty. Multiple surveys are often taken over the same portion of a wellbore either concurrently or sequentially and/or using various instruments. Each survey generates an estimated survey position and related uncertainty for a given location in the wellbore. By combining the estimated survey positions and uncertainties for these overlapping surveys, a resultant position and related ellipsoid of uncertainty is estimated. This resultant position estimates a position in the wellbore by incorporating the estimated survey positions and uncertainties of multiple overlapping surveys.

26 Claims, 3 Drawing Sheets

METHOD FOR ESTIMATING A POSITION OF A WELLBORE

BACKGROUND OF INVENTION

1. Field of the Invention

The invention relates generally to wellbore surveys. More particularly, the invention relates to the estimation of wellbore positions based on analytical techniques.

2. Background Art

Fluids, such as oil, gas and water, are commonly recovered from subterranean formations below the earth's surface. Drilling rigs at the surface are often used to bore long, slender wellbores into the earth's crust to the location of the subsurface fluid deposits to establish fluid communication with the surface through the drilled wellbore. The location of subsurface fluid deposits may not be located directly (vertically downward) below the drilling rig surface location. A wellbore that defines a path, which deviates from vertical to some laterally displaced location, is called a directional wellbore. Downhole drilling equipment may be used to directionally steer the wellbore to known or suspected fluid deposits using directional drilling techniques to laterally displace the borehole and create a directional wellbore.

The path of a wellbore, or its "trajectory," is made up of a series of positions at various points along the wellbore obtained by using known calculation methods. "Position," as the term is used herein, refers to an orthogonal Cartesian (x, y, z) spatial position, referenced to some vertical and/or horizontal datum (usually the well-head position and elevation reference). The position may also be obtained using inertial measurement techniques, or by using inclination and azimuth with known calculation methods. "Azimuth" may be considered, for present purposes, to be the directional angular heading, relative to a reference direction, such as North, at the position of measurement. "Inclination" may be considered, also for present purposes, to be the angular deviation from vertical of the borehole at the position of measurement.

Directional wellbores are drilled through earth formations along a selected trajectory. Many factors may combine to unpredictably influence the intended trajectory of a wellbore. It is desirable to accurately estimate the wellbore trajectory in order to guide the wellbore to its geological and/or positional objective. This makes it desirable to measure the inclination, azimuth and depth of the wellbore during wellbore operations to estimate whether the selected trajectory is being maintained.

The drilled trajectory of a wellbore is estimated by the use of a wellbore or directional survey. A wellbore survey is made up of a collection or "set" of survey-stations. A survey station is generated by taking measurements used for estimation of the position and/or wellbore orientation at a single position in the wellbore. The act of performing these measurements and generating the survey stations is termed "surveying the wellbore."

Surveying of wellbores is commonly performed using downhole survey instruments. These instruments typically contain sets of orthogonal accelerometers, magnetometers and/or gyroscopes. These survey instruments are used to measure the direction and magnitude of the local gravitational, magnetic field and/or earth spin rate vectors respectively, herein referred to as "earth's vectors". These measurements correspond to the instrument position and orientation in the wellbore, with respect to earth vectors. Wellbore position, inclination and/or azimuth may be estimated from the instrument's measurements.

One or more survey stations may be generated using "discrete" or "continuous"measurement modes. Generally, discrete or "static" wellbore surveys are performed by creating survey stations along the wellbore when drilling is stopped or interrupted to add additional joints or stands of drillpipe to the drillstring at the surface. Continuous wellbore surveys relate to thousands of measurements of the earth's vectors and/or angular velocity of a downhole tool obtained for each wellbore segment using the survey instruments. Successive measurements of these vectors during drilling operations may be separated by only fractions of a second or thousandths of a meter and, in light of the relatively slow rate of change of the vectors in drilling a wellbore, these measurements are considered continuous for all practical analyses.

Known survey techniques as used herein encompass the utilization of a variety of means to estimate wellbore position, such as using sensors, magnetometers, accelerometers, gyroscopes, measurements of drill pipe length or wireline depth, Measurement While Drilling ("MWD") tools, Logging While Drilling ("LWD") tools, wireline tools, seismic data, and the like.

Surveying of a wellbore is often performed by inserting one or more survey instrument into a bottom-hole-assembly ("BHA"), and moving the BHA into or out of the wellbore. At selected intervals, usually about every 30 to 90 feet (10 to 30 meters), BHA, having the instrument therein, is stopped so that measurement can be made for the generation of a survey station. An additional measurement not performed by the survey instruments is the estimation of the along hole depth (measured depth "MD") or wellbore distance between discrete survey stations. The MD corresponds to the length of joints or stands of drillpipe added at the surface down to the BHA survey station measurement position. The measurements of inclination and azimuth at each survey station along with the MD are then entered into any one of a number of well-known position calculation models to estimate the position of the survey station to further define the wellbore trajectory up to that survey station.

Existing wellbore survey computation techniques use various models, including the Tangential method, Balanced Tangential method, Average Angle method, Mercury method, Differential Equation method, cylindrical Radius of Curvature method and the Minimum Radius of Curvature method, to model the trajectory of the wellbore segments between survey stations.

Directional surveys may also be performed using wireline tools. Wireline tools are provided with one or more survey probes suspended by a cable and raised and lowered into and out of a wellbore. In such a system, the survey stations are generated in any of the previously mentions surveying modes to create the survey. Often wireline tools are used to survey wellbores after a drilling tool has drilled a wellbore and an MWD and/or LWD survey has been previously performed.

Uncertainty in the survey results from measurement uncertainty, as well as environmental factors. Measurement uncertainty may exist in any of the known survey techniques. For example, magnetic measuring techniques suffer from the inherent uncertainty in global magnetic models used to estimate declination at a specific site. Similarly, gravitational measuring techniques suffer from movement of the downhole tool and uncertainties in the accelerometers. Gyroscopic measuring techniques, for example, suffer from drift uncertainty. Depth measurements are also prone to uncertainties including mechanical stretch from gravitational forces and thermal expansion, for example.

Various considerations have brought about an ever-increasing need for more precise wellbore surveying techniques. More accurate survey information is necessary to ensure the avoidance of well collisions and the successful penetration of geological targets.

Surveying techniques have been utilized to estimate the wellbore position. For example, techniques have also been developed to estimate the position of wellbore instruments downhole. U.S. Pat. No. 6,026,914 to Adams et al. relates to a wellbore profiling system utilizing multiple pressure sensors to establish the elevation along the wellbore path. U.S. Pat. No. 4,454,756 to Sharp et al. relates to an inertial wellbore survey system, which utilizes multiple accelerometers, and gyros to serially send signals uphole. U.S. Pat. No. 6,302,204 B1 to Reimers et al. relates to a method of conducting subsurface seismic surveys from one or more wellbores from a plurality of downhole sensors. U.S. Pat. No. 5,646,611 to Dailey et al. relates to the use of two inclinometers in a drilling tool to estimate the inclination angle of the wellbore at the bit.

Other techniques have been developed to correct data based on measurement error. U.S. Pat. No. 6,179,067 B1 to Brooks relates to a method for correcting measurement errors during survey operations by correcting observed data to a model. U.S. Pat. No. 5,452,518 to DiPersio relates to a method of estimating wellbore azimuth by utilizing a plurality of estimates of the axial component of the measured magnetic field by emphasizing the better estimates and de-emphasizing poorer estimates to compensate for magnetic field biasing error.

There remains a need for techniques capable of utilizing overlapping survey data to better estimate the wellbore position and its related uncertainty of that position. Mathematical models have been used to estimate the wellbore position and position uncertainty in a wellbore. For example, SPE 56702 entitled "Accuracy Prediction for Directional MWD," by Hugh S. Williamson (©1999), SPE 9223 entitled "Borehole Position Uncertainty, Analysis of Measuring Methods and Derivation of Systematic Error Model," by Chris J. M. Wolff and John P. De Wardt (©1981), and "Accuracy Prediction for Directional Measurement While Drilling," by H. S. Williamson, SPE Drill and Completion, Vol. 15, No. 4 Dec. 2000, the entire contents of which are hereby incorporated by reference, describe mathematical techniques used in wellbore position analysis. However, a specific position in a wellbore is often surveyed many times and by many different types of survey instruments at various stages of wellbore operations. Historically, these existing methods rely upon a sequence of non-overlapping surveys along the wellbore to estimate the position of a point in the wellbore, and fail to incorporate overlapping survey data.

It is desirable that overlapping surveys be taken into consideration when estimating positions in a wellbore. It is also desirable that a method of estimating positions in the wellbore, use overlapping surveys generated by downhole tools. The present invention provides a technique, which utilizes multiple overlapping surveys and combines the overlapping surveyed positions and related positional uncertainties of a given wellpath in order to produce a resultant wellbore position, or 'Most Probable Position' (MPP), as well as an associated resultant positional uncertainty.

SUMMARY OF INVENTION

An aspect of the invention relates to a method for estimating a position in a wellbore. The method involves acquiring a plurality of surveys of the wellbore and combining overlapping portions of the surveys whereby the wellbore position is determined. Each measured survey defines a survey position in the wellbore and an uncertainty of the survey position.

Another aspect of the invention relates to a method for estimating a position in a wellbore. The method involves drilling a wellbore into a subterranean formation, acquiring a plurality of surveys of the wellbore and combining overlapping portions of the surveys whereby the wellbore position is determined. Each measured survey defines a survey position in the wellbore and an uncertainty of the survey position.

Another aspect of the invention relates to a method for estimating a position in a wellbore. The method involves taking a plurality of surveys of the wellbore and combining overlapping portions of the surveys whereby the wellbore position is determined. Each measured survey defines a survey position in the wellbore and an uncertainty of the survey position.

Another aspect of the invention relates to a method for estimating a position in a wellbore. The method involves acquiring a plurality of surveys of the wellbore and combining overlapping portions of the surveys whereby the wellbore position is determined. Each measured survey defines a survey position in the wellbore and an uncertainty of the survey position. The surveys are combined using the following equation: $MPP=((H_n^T Cov_n^{-1} H_n)^{-1} H_n^T Cov_n^{-1})*V$.

Other aspects and advantages of the invention will be apparent from the following description and the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
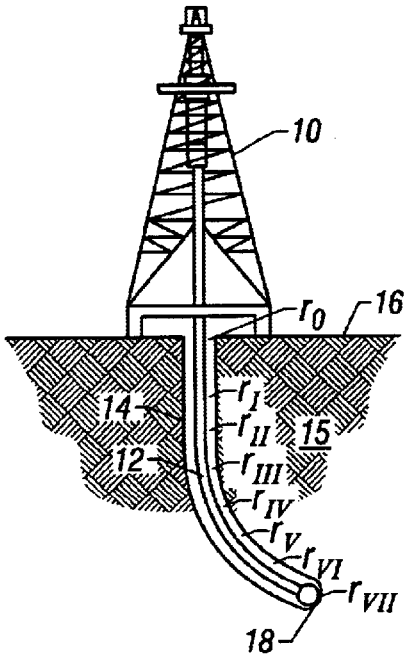
FIG. 1 is a schematic view of a drilling rig having a drilling apparatus extending into a wellbore penetrating a subterranean formation to survey the wellbore.

Referring now to the drawings in general and FIG. 1 in particular, an environment in which the present invention may be utilized is depicted. FIG. 1 shows drilling rig 10 having a drilling tool 12 extending downhole into a wellbore 14 penetrating a subterranean formation 15. The drilling tool 12 extends from the surface 16 at known position $r_0$ to the bottom 18 of the wellbore 14 at estimated survey position $r_{VII}$. Incremental survey positions $r_I$ through $r_{VI}$ extend between $r_0$ and $r_{VII}$. Incremental survey positions $r_I$ through $r_{VII}$ are estimated and/or measured using one or more of the known survey techniques.

The drilling tool 12 depicted in FIG. 1 is capable of collecting survey data and other information while the drilling tool drills the wellbore using known survey techniques. The drilling tool 12 may be used to survey and/or collect data before, during or after a drilling operation. The measurements taken using the drilling tool may be done continuously and/or at discrete positions in the wellbore. The drilling tool 12 is also capable of surveying and/or collecting data as the tool is extended downhole and/or retrieved uphole in a continuous and/or discrete manner. The drilling tool 12 is capable of taking a survey along one or more of the survey points $r_0$ through $r_{VII}$.

Figure 2:
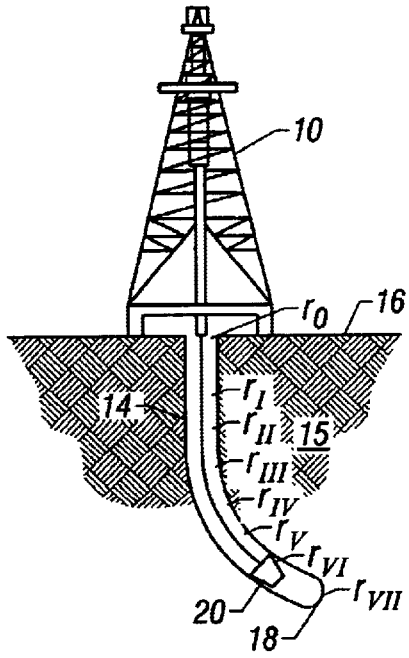
FIG. 2 is a schematic view of the wellbore of FIG. 4 having a wireline tool positioned therein to survey the wellbore.

Referring now to FIG. 2, the drilling rig 10 of FIG. 1 is shown with a wireline tool 20 extending into the wellbore 14. The wireline tool 20 is lowered into the wellbore 14 to survey and/or collect data. The wireline tool 20 is capable of surveying and/or collecting data as the tool is extended downhole and/or retrieved uphole in a continuous and/or discrete manner. As with the drilling tool, the wireline tool is also capable of taking a survey along one or more of the survey points $r_0$ through $r_{VII}$ as the tool is advanced uphole and/or downhole.

As shown in FIGS. 1 and 2, various tools may be used to take one or more surveys (individually and/or collectively) in a continuous and/or discrete manner as will be appreciated by one skilled in the art. For simplicity, a curved wellbore is shown; however, the wellbore may be of any size or shape, vertical, horizontal and/or curved. Additionally, the wellbore may be a land unit as shown, or an offshore well.

Figure 3:
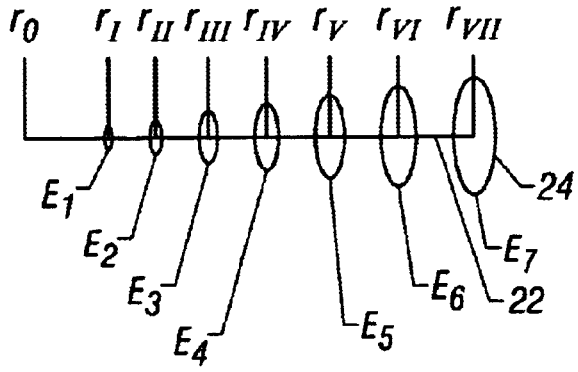
FIG. 3 is a graphic depiction of survey points along a path and their associated ellipsoids of uncertainty.

The estimated survey positions and related positional uncertainty associated with surveys is mathematically depicted in as shown in FIG. 3. FIG. 3 represents a plurality of surveys taken along a wellbore beginning at a known reference position $r_0$ and terminating at an estimated survey position $r_{VII}$, with estimated survey positions $r_I$ through $r_{VI}$ therebetween. The position of survey positions $r_I$ through $r_{VII}$ is estimated using known survey techniques. As depicted in FIG. 3, estimated survey positions $r_I$ through $r_{VII}$ are progressively further away from known reference position $r_0$. The estimated survey positions $r_I$ through $r_{VII}$ may be connected to form an estimated trajectory 22 using known survey techniques.

Figure 4:
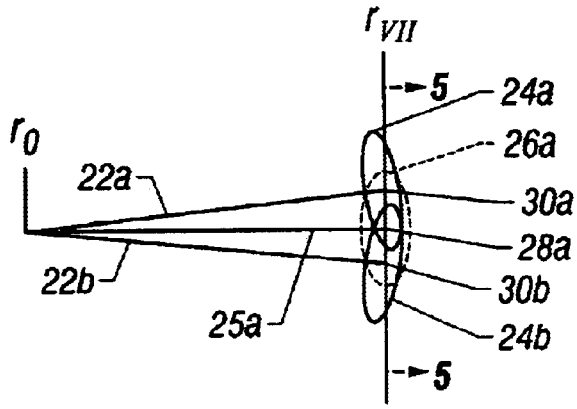
FIG. 4 is graphic depiction of two surveys and related uncertainties at a position along a path combined to estimate a resultant position and resultant uncertainty.
Figure 5:
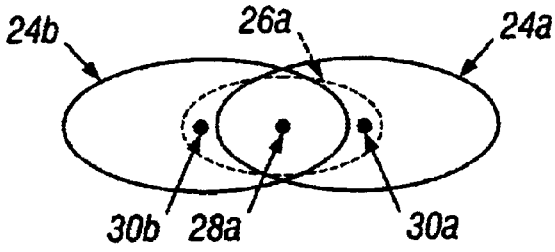
FIG. 5 is a cross-sectional view of the graphic depiction of FIG. 4 taken along line 5—5.

Because $r_0$ is known, it is presumed to have little or no uncertainty. As depicted in FIG. 3, the estimated position of each survey point $r_I$ through $r_{VII}$ has an "ellipsoid of uncertainty" $E_1$ through $E_7$ surrounding a corresponding survey point, respectively. Each ellipsoids E represent the uncertainty associated with its respective position.

Where overlapping surveys are taken along a wellbore, they may be combined, as visually depicted in FIG. 4. A first survey is taken from a known position $r_0$ to an estimated position $r_{VII}$. With respect to FIG. 4, a first trajectory 22*a* beginning at an known position 25*a* and extending to an estimated survey position 30*a* having an ellipsoid of uncertainty 24*a* is shown. A second trajectory 22*b* beginning at known position 25*a* and extending to an estimated survey position 30*b* having an ellipsoid of uncertainty 24*b* is also shown. First survey position 30*a* and its first ellipsoid of uncertainty 24*a* is combined with second survey position 30*b* and its second ellipsoid of uncertainty 24*b* to form a resultant position 28*a*. Similarly, first ellipsoid of uncertainty 24*a* is combined with second ellipsoid of uncertainty 24*b* to form a resultant ellipsoid of uncertainty 26*a*. For further clarity, a cross-sectional view of FIG. 4 taken along line 5—5 is depicted in FIG. 5.

The combination of the survey positions r may also be represented by mathematical calculations. Overlapping estimated survey positions may be characterized in the form of a position vector V. Position vector V contains position vectors r for each of n overlapping surveys performed at a position in a wellbore. Each position vector r has an x, y and z coordinate representing a survey position estimated by known survey techniques. The position vector V combines the position vectors r to form the stacked 3n×1 vector V below:

$$V = \begin{vmatrix} r_{1x} \\ r_{1y} \\ r_{1z} \\ r_{2x} \\ r_{2y} \\ r_{2z} \\ \vdots \\ r_{nx} \\ r_{ny} \\ r_{nz} \end{vmatrix}$$

The ellipsoid of uncertainty for each estimated survey position vector r having an (x, y and z) coordinate, is mathematically represented by the covariance matrix ($Cov_r$) set forth below, and the combination of the $Cov_r$ matrices for n overlapping surveys is mathematically represented by the 3n×3n covariance matrix ($Cov_n$) set forth below:

$$Cov_r = \begin{bmatrix} \langle \delta r_x \delta r_x \rangle & \langle \delta r_x \delta r_y \rangle & \langle \delta r_x \delta r_z \rangle \\ \langle \delta r_y \delta r_x \rangle & \langle \delta r_y \delta r_y \rangle & \langle \delta r_y \delta r_z \rangle \\ \langle \delta r_z \delta r_x \rangle & \langle \delta r_y \delta r_z \rangle & \langle \delta r_y \delta r_z \rangle \end{bmatrix}$$

$$Cov_n = \begin{bmatrix} \langle \delta r1_x \delta r1_x \rangle & \langle \delta r1_x \delta r1_y \rangle & \langle \delta r1_x \delta r1_z \rangle & \cdots & \langle \delta r1_x \delta rn_x \rangle & \langle \delta r1_x \delta rn_y \rangle & \langle \delta r1_x \delta rn_z \rangle \\ \langle \delta r1_y \delta r1_x \rangle & \langle \delta r1_y \delta r1_y \rangle & \langle \delta r1_x \delta r1_x \rangle & \cdots & \langle \delta r1_y \delta rn_x \rangle & \langle \delta r1_y \delta rn_y \rangle & \langle \delta r1_y \delta rn_z \rangle \\ \langle \delta r1_z \delta r1_x \rangle & \langle \delta r1_z \delta r1_y \rangle & \langle \delta r1_z \delta r1_z \rangle & \cdots & \langle \delta r1_z \delta rn_x \rangle & \langle \delta r1_z \delta rn_y \rangle & \langle \delta r1_z \delta rn_z \rangle \\ \vdots & \vdots & \vdots & \ddots & \vdots & \vdots & \vdots \\ \langle \delta rn_x \delta r1_x \rangle & \langle \delta rn_x \delta r1_y \rangle & \langle \delta rn_x \delta r1_z \rangle & \cdots & \langle \delta rn_x \delta rn_x \rangle & \langle \delta rn_x \delta rn_y \rangle & \langle \delta rn_x \delta rn_z \rangle \\ \langle \delta rn_y \delta r1_x \rangle & \langle \delta rn_y \delta r1_y \rangle & \langle \delta rn_y \delta r1_z \rangle & \cdots & \langle \delta rn_y \delta rn_x \rangle & \langle \delta rn_y \delta rn_y \rangle & \langle \delta rn_y \delta rn_z \rangle \\ \langle \delta rn_z \delta r1_x \rangle & \langle \delta rn_z \delta r1_y \rangle & \langle \delta rn_y \delta r1_z \rangle & \cdots & \langle \delta rn_z \delta rn_x \rangle & \langle \delta rn_z \delta rn_y \rangle & \langle \delta rn_z \delta rn_z \rangle \end{bmatrix}$$

This 3n×3n matrix ($Cov_n$) defines the auto and cross covariance between associated estimated survey positions (r). The covariance represents the statistical relationship between the estimated survey positions. The resultant position of the combined surveys, or "Most Probable Position (MPP)", may then be calculated using the following equation:

$$MPP = ((H_n^T \mathrm{Cov}_n^{-1} H_n)^{-1} H_n^T \mathrm{Cov}_n^{-1}) * V$$

Where H is the 3×3 identity matrix, $H_n$ consists of n3×3 identity matrices stacked up where n is number of overlapping surveys and HUT is the transpose of $H_n$ as set forth below:

$$H = \begin{vmatrix} 1 & 0 & 0 \\ 0 & 1 & 0 \\ 0 & 0 & 1 \end{vmatrix} \qquad H_n = \begin{vmatrix} 1_1 & 0 & 0 \\ 0 & 1_1 & 0 \\ 0 & 0 & 1_1 \\ 1_2 & 0 & 0 \\ 0 & 1_2 & 0 \\ 0 & 0 & 1_2 \\ \vdots & \vdots & \vdots \\ 1_n & 0 & 0 \\ 0 & 1_n & 0 \\ 0 & 0 & 1_n \end{vmatrix}$$

$$H_n^T = \begin{vmatrix} 1_1 & 0 & 0 & 1_2 & 0 & 0 & \cdots & 1_n & 0 & 0 \\ 0 & 1_1 & 0 & 0 & 1_2 & 0 & \cdots & 0 & 1_n & 0 \\ 0 & 0 & 1_1 & 0 & 0 & 1_2 & \cdots & 0 & 0 & 1_n \end{vmatrix}$$

The corresponding resultant positional uncertainty for the resultant position (MPP) is defined by a covariance matrix represented by the following equation:

$$\mathrm{Cov}_{MPP}=(H_n^T\mathrm{Cov}_n^{-1}H_n)^{-1}$$

The resultant position (MPP) and corresponding resultant positional uncertainty($\mathrm{Cov}_{MPP}$) represent the position and uncertainty for n overlapping surveys having been combined using this technique.

Figure 6:
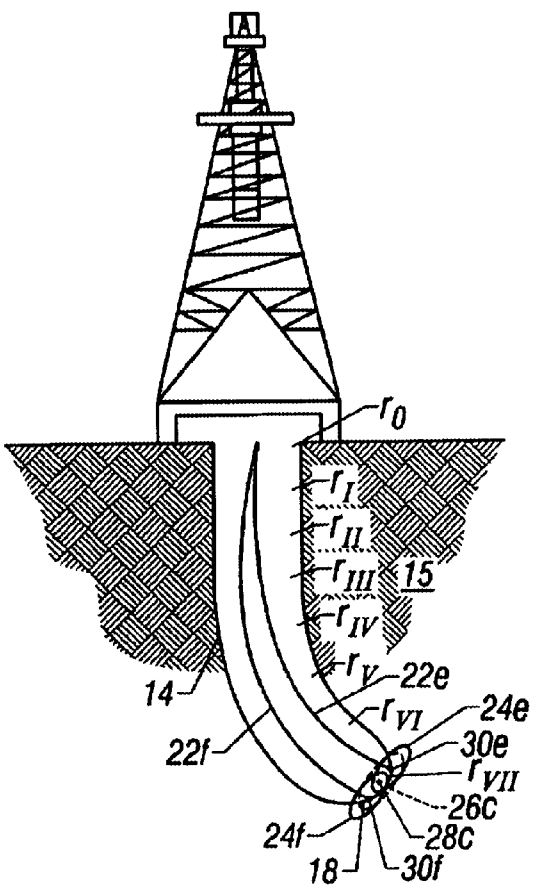
FIG. 6 is a schematic view of the wellbore of FIG. 1 depicts a resultant position determined from overlapping estimated survey positions and related ellipsoids of uncertainty at position $r_{VII}$ in the wellbore.

Applying the mathematical model to wellbore operations, the surveys and ellipsoids of uncertainty for multiple overlapping surveys of a wellbore are depicted in FIG. 6. Each survey performed along the wellbore generates data indicating the survey position of the wellbore with its related ellipsoid of uncertainty at points $r_0$ through $r_{VII}$. FIG. 6 depicts a first trajectory 22*e* taken along wellbore 14 using the drilling tool of FIG. 1, and a second trajectory 22*f* taken along wellbore 14 using the wireline tool of FIG. 2. At wellbore position $r_{VII}$, the first trajectory terminates at a first survey position 30*e* having an ellipsoid of uncertainty 24*e*, and second trajectory terminates at a second survey position 30*f* having a second ellipsoid of uncertainty 24*f*. The first and second survey positions 30*e* and 30*f* and their corresponding first and second ellipsoids of uncertainty 24*e* and 24*f* are combined to generate a resultant position (MPP) 28*c* and corresponding resultant ellipsoid of uncertainty 26*c*.

While FIG. 6 depicts two overlapping surveys combined to generate the resultant position and related ellipsoid of uncertainty, it will be appreciated that multiple overlapping surveys may be combined to generate the resultant position (MPP) and related resultant uncertainty. Applying the mathematical principles to the wellbore operation set forth in FIG. 6, the resultant position of the wellbore at point $r_{VII}$ may be estimated. During the wellbore operation of a section of the wellbore 14, surveys are recorded along a wellpath using known survey techniques resulting in an estimated survey position along the wellpath. These surveys positions are generally referenced to a measured or assigned depth, or distance along the wellpath from a known surface location.

During wellbore operations, various survey measurements produce one or more overlapping estimated survey positions along the wellpath. This technique can then be applied to combine any number of overlapping survey measurements at the same wellbore position for any interval over the wellpath for which such multiple survey measurements exist.

For example, the first survey 22*e* may produce a survey position 30*e* represented by $r_1$ (x,y,z)=(10,10,100), and the second survey 22*f* may produce survey position 30*f* represented by $r_2$ (x,y,z)=(−10,−10,120). These measurements may be translated into the following position vector:

$$V=[10;10;100;-10;-10;120]$$

In this example, each of the overlapping estimated survey positions has a given uncertainty represented by $\mathrm{Cov}_1$ and $\mathrm{Cov}_2$ as depicted in the covariant matrix below:

$$\mathrm{Cov}_1 \text{ and } \mathrm{Cov}_2=[100,0,0;0,169,0;0,0,25]$$

The $\mathrm{Cov}_1$ and $\mathrm{Cov}_2$ matrix generates the following covariance matrix:

$$Cov_n = \begin{matrix} 100 & 0 & 0 & 0 & 0 & 0 \\ 0 & 169 & 0 & 0 & 0 & 0 \\ 0 & 0 & 25 & 0 & 0 & 0 \\ 0 & 0 & 0 & 100 & 0 & 0 \\ 0 & 0 & 0 & 0 & 169 & 0 \\ 0 & 0 & 0 & 0 & 0 & 25 \end{matrix}$$

The first and second overlapping surveys may be combined to generate the MPP as follows:

$$MPP=((H_n^T\mathrm{Cov}_n^{-1}H_n)^{-1}H_n^T\mathrm{Cov}_n^{-1})*V$$

$$MPP=0,0,110$$

where:

$$H_n=[1\ 0\ 0;0\ 1\ 0;0\ 0\ 1;1\ 0\ 0;0\ 1\ 0;0\ 0\ 1]$$

and n=2

In this example, the resultant position vector is equidistant between the two survey points as expected for this example. The covariance matrix may then be solved as follows:

$$Cov_{MPP} = (H_n^T Cov_n^{-1} H_n)^{-1} = \begin{matrix} 50 & 0 & 0 \\ 0 & 84.5 & 0 \\ 0 & 0 & 12.5 \end{matrix}$$

The result of this process is then a resultant position 28*c* (MPP) based on combining overlapping surveys at the same position $r_{VII}$ in the wellbore.

For simplicity, this example incorporated positions with identical covariance matrices; however, it will be appreciated that different surveys may have different covariance matrices.

Figure 7:
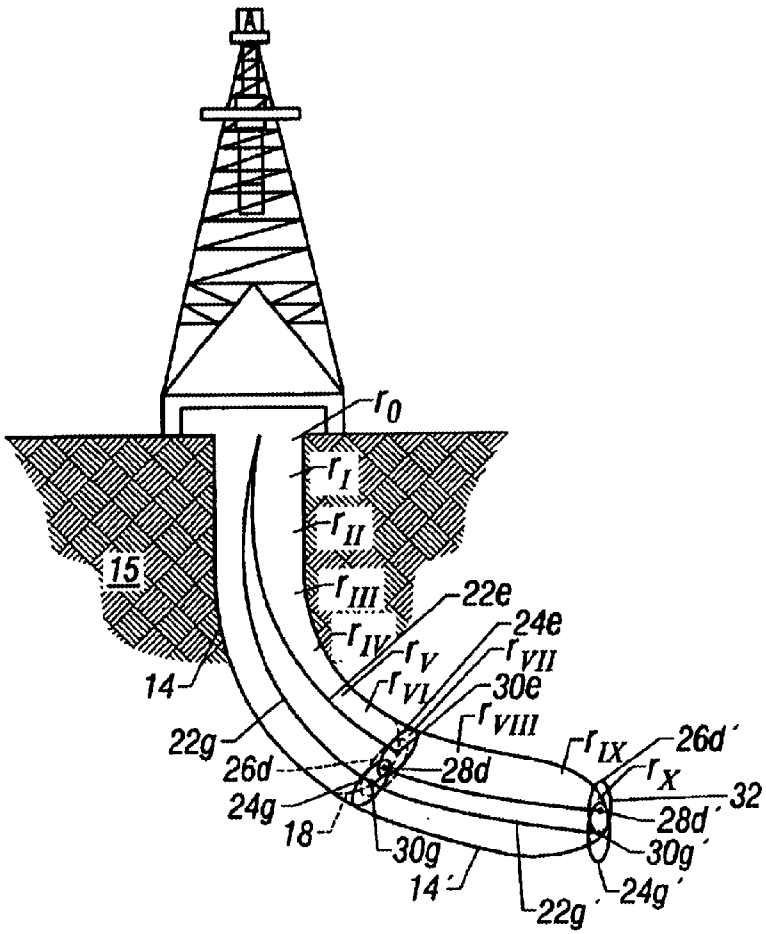
FIG. 7 is a schematic view of the wellbore of FIG. 6 extended a distance further into the subterranean formation and depicting a resultant position determined from overlapping portions of estimated survey positions and related ellipsoids of uncertainty.

Referring now to FIG. 7, the wellbore 14 of FIG. 1 is drilled further into formation 15. The wellbore 14 extends beyond original bottom 18 at position $r_{VII}$ to new bottom 32 at position $r_X$. A new survey is typically taken during the subsequent drilling operation for the extended wellbore 14,' or by a wireline tool. The portion 22*g* of the new survey of wellbore 14' along points $r_0$ to $r_{VII}$ may be combined with existing surveys of the original wellbore 14 (FIGS. 1, 2 and 6) from overlapping positions $r_0$ to $r_{VII}$ as heretofore described. The estimated survey positions 30*e* and 30*g* at position $r_{VII}$ in the wellbore and related ellipsoids of uncertainty 24*e* and 24*g*, respectively, may be combined as heretofore described to generate resultant position (MPP) 28*d* and related ellipsoid of uncertainty 26*d*. The portion 22*g*' of the new survey of wellbore 14' along point $r_{VIII\ to\ rX}$ has an estimated survey position 30*g*' and related ellipsoid of uncertainty 24*g*'.

The resultant position 28*d* may then be used to calculate a resultant position 28*d*' at wellbore position $r_X$ using known survey techniques. This can be expressed as the equation:

$$\mathbf{28}d' = \mathbf{28}d + (\mathbf{28}d' - \mathbf{28}d)$$

The ellipsoid of uncertainty 26*d*' for resultant position 28*d*' may then be estimated using known techniques by applying the following equation:

$$\langle \delta 28d' \delta 28d'^{tr} \rangle = \langle \delta 28d \delta 28d^{tr} \rangle + \left\langle (\delta 28d' - \delta 28d)(\delta 28d' - \delta 28d)^{tr} \right\rangle \left\langle \delta 28d (\delta 28d' - \delta 28d)^{tr} \right\rangle + \left\langle (\delta 28d' - \delta 28d) \delta 28d^{tr} \right\rangle$$

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for estimating a position of a wellbore, comprising:

acquiring a plurality of surveys of the wellbore, each survey defining a survey position of the wellbore and an uncertainty of the survey position; and combining the uncertainties of the survey positions whereby the wellbore position is determined.

2. The method of claim 1 wherein in the step of acquiring, at least one survey is taken while drilling the wellbore.

3. The method of claim 2 wherein in the step of acquiring, at least one survey is taken using a wireline tool.

4. The method of claim 1 further comprising the step of extending the wellbore a distance further thereby defining an extended wellbore, and wherein in the step of acquiring, at least a portion of at least one survey is taken of the extended wellbore.

5. The method of claim 4 further comprising estimating a position in the extended wellbore using the wellbore position.

6. The method of claim 1 wherein in the step of acquiring, at least one survey is taken using a wireline tool.

7. The method of claim 1 wherein in the step of combining, the wellbore position is estimated using the following equation:

$$MPP = ((H_n^T \mathrm{Cov}_n^{-1} H_n)^{-1} H_n^T \mathrm{Cov}_n) * V$$

where $$H_n = \begin{vmatrix} 1_1 & 0 & 0 \\ 0 & 1_1 & 0 \\ 0 & 0 & 1_1 \\ 1_2 & 0 & 0 \\ 0 & 1_2 & 0 \\ 0 & 0 & 1_2 \\ \vdots & \vdots & \vdots \\ 1_n & 0 & 0 \\ 0 & 1_n & 0 \\ 0 & 0 & 1_n \end{vmatrix} \qquad H_n^T = \begin{vmatrix} 1_1 & 0 & 0 & 1_2 & 0 & 0 & \cdots & 1_n & 0 & 0 \\ 0 & 1_1 & 0 & 0 & 1_2 & 0 & \cdots & 0 & 1_n & 0 \\ 0 & 0 & 1_1 & 0 & 0 & 1_2 & \cdots & 0 & 0 & 1_n \end{vmatrix}$$

$$Cov_n = \begin{bmatrix} \langle \delta r1_x \delta r1_x \rangle & \langle \delta r1_x \delta r1_y \rangle & \langle \delta r1_x \delta r_z \rangle & \cdots & \langle \delta r1_x \delta rn_x \rangle & \langle \delta r1_x \delta rn_y \rangle & \langle \delta r1_x \delta rn_z \rangle \\ \langle \delta r1_y \delta r1_x \rangle & \langle \delta r1_y \delta r1_y \rangle & \langle \delta r1_x \delta r1_x \rangle & \cdots & \langle \delta r1_y \delta rn_x \rangle & \langle \delta r1_y \delta rn_y \rangle & \langle \delta r1_y \delta rn_z \rangle \\ \langle \delta r1_z \delta r1_x \rangle & \langle \delta r1_z \delta r1_y \rangle & \langle \delta r1_z \delta r1_z \rangle & \cdots & \langle \delta r1_z \delta rn_x \rangle & \langle \delta r1_z \delta rn_y \rangle & \langle \delta r1_z \delta rn_z \rangle \\ \vdots & \vdots & \vdots & \ddots & \vdots & \vdots & \vdots \\ \langle \delta rn_x \delta r1_x \rangle & \langle \delta rn_x \delta r1_y \rangle & \langle \delta rn_x \delta r1_z \rangle & \cdots & \langle \delta rn_x \delta rn_x \rangle & \langle \delta rn_x \delta rn_y \rangle & \langle \delta rn_x \delta rn_z \rangle \\ \langle \delta rn_y \delta r1_x \rangle & \langle \delta rn_y \delta r1_y \rangle & \langle \delta rn_y \delta r1_z \rangle & \cdots & \langle \delta rn_y \delta rn_x \rangle & \langle \delta rn_y \delta rn_y \rangle & \langle \delta rn_y \delta rn_z \rangle \\ \langle \delta rn_z \delta r1_x \rangle & \langle \delta rn_z \delta r1_y \rangle & \langle \delta rn_y \delta r1_z \rangle & \cdots & \langle \delta rn_z \delta rn_x \rangle & \langle \delta rn_z \delta rn_y \rangle & \langle \delta rn_z \delta rn_z \rangle \end{bmatrix}$$

$$V = \begin{vmatrix} r_{1x} \\ r_{1y} \\ r_{1z} \\ r_{2x} \\ r_{2y} \\ r_{2z} \\ \vdots \\ r_{nx} \\ r_{ny} \\ r_{nz} \end{vmatrix} \qquad Cov_r = \begin{bmatrix} \langle \delta r_x \delta r_x \rangle & \langle \delta r_x \delta r_y \rangle & \langle \delta r_x \delta r_z \rangle \\ \langle \delta r_y \delta r_x \rangle & \langle \delta r_y \delta r_y \rangle & \langle \delta r_y \delta r_z \rangle \\ \langle \delta r_z \delta r_x \rangle & \langle \delta r_y \delta r_z \rangle & \langle \delta r_y \delta r_z \rangle \end{bmatrix}$$

r=the position of each survey point (1–n) having (x,y,z) coordinates n=the number of surveys taken.-

8. The method of claim 7 wherein the resultant uncertainty is calculated from the equation:

$$\mathrm{Cov}_{MPP}=(H_n^T\mathrm{Cov}_n^{-1}H_n)^{-1}.$$

14. The method of claim 9 wherein in the step of acquiring, at least one survey is taken using a wireline tool.

15. The method of claim 9 wherein in the step of combining, the wellbore position is estimated using the following equation:

$$MPP=((H_n^T\mathrm{Cov}_n^{-1}H_n)^{-1}H_n^T\mathrm{Cov}_n^{-1})*V$$

where $$H_n=\begin{vmatrix} 1_1 & 0 & 0 \\ 0 & 1_1 & 0 \\ 0 & 0 & 1_1 \\ 1_2 & 0 & 0 \\ 0 & 1_2 & 0 \\ 0 & 0 & 1_2 \\ \vdots & \vdots & \vdots \\ 1_n & 0 & 0 \\ 0 & 1_n & 0 \\ 0 & 0 & 1_n \end{vmatrix} \qquad H_n^T=\begin{vmatrix} 1_1 & 0 & 0 & 1_2 & 0 & 0 & \cdots & 1_n & 0 & 0 \\ 0 & 1_1 & 0 & 0 & 1_2 & 0 & \cdots & 0 & 1_n & 0 \\ 0 & 0 & 1_1 & 0 & 0 & 1_2 & \cdots & 0 & 0 & 1_n \end{vmatrix}$$

$$Cov_n=\begin{bmatrix} \langle\delta r1_x\delta r1_x\rangle & \langle\delta r1_x\delta r1_y\rangle & \langle\delta r1_x\delta r_z\rangle & \cdots & \langle\delta r1_x\delta rn_x\rangle & \langle\delta r1_x\delta rn_y\rangle & \langle\delta r1_x\delta rn_z\rangle \\ \langle\delta r1_y\delta r1_x\rangle & \langle\delta r1_y\delta r1_y\rangle & \langle\delta r1_x\delta r1_x\rangle & \cdots & \langle\delta r1_y\delta rn_x\rangle & \langle\delta r1_y\delta rn_y\rangle & \langle\delta r1_y\delta rn_z\rangle \\ \langle\delta r1_z\delta r1_x\rangle & \langle\delta r1_z\delta r1_y\rangle & \langle\delta r1_z\delta r1_z\rangle & \cdots & \langle\delta r1_z\delta rn_x\rangle & \langle\delta r1_z\delta rn_y\rangle & \langle\delta r1_z\delta rn_z\rangle \\ \vdots & \vdots & \vdots & \ddots & \vdots & \vdots & \vdots \\ \langle\delta rn_x\delta r1_x\rangle & \langle\delta rn_x\delta r1_y\rangle & \langle\delta rn_x\delta r1_z\rangle & \cdots & \langle\delta rn_x\delta rn_x\rangle & \langle\delta rn_x\delta rn_y\rangle & \langle\delta rn_x\delta rn_z\rangle \\ \langle\delta rn_y\delta r1_x\rangle & \langle\delta rn_y\delta r1_y\rangle & \langle\delta rn_y\delta r1_z\rangle & \cdots & \langle\delta rn_y\delta rn_x\rangle & \langle\delta rn_y\delta rn_y\rangle & \langle\delta rn_y\delta rn_z\rangle \\ \langle\delta rn_z\delta r1_x\rangle & \langle\delta rn_z\delta r1_y\rangle & \langle\delta rn_y\delta r1_z\rangle & \cdots & \langle\delta rn_z\delta rn_x\rangle & \langle\delta rn_z\delta rn_y\rangle & \langle\delta rn_z\delta rn_z\rangle \end{bmatrix}$$

$$V=\begin{vmatrix} r_{1x} \\ r_{1y} \\ r_{1z} \\ r_{2x} \\ r_{2y} \\ r_{2z} \\ \vdots \\ r_{nx} \\ r_{ny} \\ r_{nz} \end{vmatrix} \qquad Cov_r=\begin{bmatrix} \langle\delta r_x\delta r_x\rangle & \langle\delta r_x\delta r_y\rangle & \langle\delta r_x\delta r_z\rangle \\ \langle\delta r_y\delta r_x\rangle & \langle\delta r_y\delta r_y\rangle & \langle\delta r_y\delta r_z\rangle \\ \langle\delta r_z\delta r_x\rangle & \langle\delta r_y\delta r_z\rangle & \langle\delta r_y\delta r_z\rangle \end{bmatrix}$$

9. A method for estimating a position of a wellbore, comprising:

drilling a wellbore into a subterranean formation;

acquiring a plurality of surveys of the wellbore, each survey defining a survey position of the wellbore and an uncertainty of the survey position; and combining the uncertainties of the survey position whereby the wellbore position is determined.

10. The method of claim 9 wherein in the step of acquiring, at least one survey is taken while drilling the wellbore.

11. The method of claim 10 wherein in the step of acquiring, at least one survey is taken using a wireline tool.

12. The method of claim 9 further comprising the step of extending the wellbore a distance further thereby defining an extended wellbore, and wherein in the step of acquiring, at least a portion of at least one survey is taken of the extended wellbore.

13. The method of claim 12 further comprising estimating a position in the extended wellbore using the wellbore position.

r=the position of each survey point (1−n) having (x,y,z) coordinates n=the number of surveys taken.

16. The method of claim 15 wherein the resultant uncertainty is calculated from the equation:

$$\mathrm{Cov}_{MPP}=(H_n^T\mathrm{Cov}_n^{-1}H_n)^{-1}.$$

17. A method for estimating a position of a wellbore, comprising:

taking a plurality of surveys of the wellbore, each survey defining a survey position of the wellbore and an uncertainty of the survey position; and combining the uncertainties of the survey positions whereby the wellbore position is determined.

18. The method of claim 17 wherein in the step of acquiring, at least one survey is taken while drilling the wellbore.

19. The method of claim 18 wherein in the step of acquiring, at least one survey is taken using a wireline tool.

20. The method of claim 17 further comprising the step of extending the wellbore a distance further thereby defining an extended wellbore, and wherein in the step of acquiring, at least a portion of at least one survey is taken of the extended wellbore.

21. The method of claim 20 further comprising estimating a position in the extended wellbore using the wellbore position.

22. The method of claim 17 wherein in the step of acquiring, at least one survey is taken using a wireline tool.

23. The method of claim 17 wherein in the step of combining, the wellbore position is estimated using the following equation:

$$MPP=((H_n^T\mathrm{Cov}_n^{-1}H_n)^{-1}H_n^T\mathrm{Cov}_n^{-1})*V$$

where $$H_n=\begin{vmatrix} 1_1 & 0 & 0 \\ 0 & 1_1 & 0 \\ 0 & 0 & 1_1 \\ 1_2 & 0 & 0 \\ 0 & 1_2 & 0 \\ 0 & 0 & 1_2 \\ \vdots & \vdots & \vdots \\ 1_n & 0 & 0 \\ 0 & 1_n & 0 \\ 0 & 0 & 1_n \end{vmatrix} \qquad H_n^T=\begin{vmatrix} 1_1 & 0 & 0 & 1_2 & 0 & 0 & \cdots & 1_n & 0 & 0 \\ 0 & 1_1 & 0 & 0 & 1_2 & 0 & \cdots & 0 & 1_n & 0 \\ 0 & 0 & 1_1 & 0 & 0 & 1_2 & \cdots & 0 & 0 & 1_n \end{vmatrix}$$

$$Cov_n=\begin{bmatrix} \langle\delta r1_x\delta r1_x\rangle & \langle\delta r1_x\delta r1_y\rangle & \langle\delta r1_x\delta r_z\rangle & \cdots & \langle\delta r1_x\delta rn_x\rangle & \langle\delta r1_x\delta rn_y\rangle & \langle\delta r1_x\delta rn_z\rangle \\ \langle\delta r1_y\delta r1_x\rangle & \langle\delta r1_y\delta r1_y\rangle & \langle\delta r1_x\delta r1_x\rangle & \cdots & \langle\delta r1_y\delta rn_x\rangle & \langle\delta r1_y\delta rn_y\rangle & \langle\delta r1_y\delta rn_z\rangle \\ \langle\delta r1_z\delta r1_x\rangle & \langle\delta r1_z\delta r1_y\rangle & \langle\delta r1_z\delta r1_z\rangle & \cdots & \langle\delta r1_z\delta rn_x\rangle & \langle\delta r1_z\delta rn_y\rangle & \langle\delta r1_z\delta rn_z\rangle \\ \vdots & \vdots & \vdots & \ddots & \vdots & \vdots & \vdots \\ \langle\delta rn_x\delta r1_x\rangle & \langle\delta rn_x\delta r1_y\rangle & \langle\delta rn_x\delta r1_z\rangle & \cdots & \langle\delta rn_x\delta rn_x\rangle & \langle\delta rn_x\delta rn_y\rangle & \langle\delta rn_x\delta rn_z\rangle \\ \langle\delta rn_y\delta r1_x\rangle & \langle\delta rn_y\delta r1_y\rangle & \langle\delta rn_y\delta r1_z\rangle & \cdots & \langle\delta rn_y\delta rn_x\rangle & \langle\delta rn_y\delta rn_y\rangle & \langle\delta rn_y\delta rn_z\rangle \\ \langle\delta rn_z\delta r1_x\rangle & \langle\delta rn_z\delta r1_y\rangle & \langle\delta rn_y\delta r1_z\rangle & \cdots & \langle\delta rn_z\delta rn_x\rangle & \langle\delta rn_z\delta rn_y\rangle & \langle\delta rn_z\delta rn_z\rangle \end{bmatrix}$$

$$V=\begin{vmatrix} r_{1x} \\ r_{1y} \\ r_{1z} \\ r_{2x} \\ r_{2y} \\ r_{2z} \\ \vdots \\ r_{nx} \\ r_{ny} \\ r_{nz} \end{vmatrix} \qquad Cov_r=\begin{bmatrix} \langle\delta r_x\delta r_x\rangle & \langle\delta r_x\delta r_y\rangle & \langle\delta r_x\delta r_z\rangle \\ \langle\delta r_y\delta r_x\rangle & \langle\delta r_y\delta r_y\rangle & \langle\delta r_y\delta r_z\rangle \\ \langle\delta r_z\delta r_x\rangle & \langle\delta r_y\delta r_z\rangle & \langle\delta r_y\delta r_z\rangle \end{bmatrix}$$

r=the position of each survey point (1–n) having (x,y,z) coordinates n=the number of surveys taken.

24. The method of claim 23 wherein the resultant uncertainty is calculated from the equation:

$$\mathrm{Cov}_{MPP}=(H_n^T\mathrm{Cov}_n^{-1}H_n)^{-1}.$$

25. A method for estimating a position in a wellbore, comprising:

acquiring a plurality of surveys of the wellbore, each survey defining a survey position in the wellbore and an uncertainty of the survey position; and combining the uncertainties of the survey positions whereby the wellbore position is determined using the following equation:

$$MPP=((H_n^T\mathrm{Cov}_n^{-1}H_n)^{-1}H_n^T\mathrm{Cov}_n^{-1})*V$$

where $$H_n = \begin{vmatrix} 1_1 & 0 & 0 \\ 0 & 1_1 & 0 \\ 0 & 0 & 1_1 \\ 1_2 & 0 & 0 \\ 0 & 1_2 & 0 \\ 0 & 0 & 1_2 \\ \vdots & \vdots & \vdots \\ 1_n & 0 & 0 \\ 0 & 1_n & 0 \\ 0 & 0 & 1_n \end{vmatrix} \qquad H_n^T = \begin{vmatrix} 1_1 & 0 & 0 & 1_2 & 0 & 0 & \cdots & 1_n & 0 & 0 \\ 0 & 1_1 & 0 & 0 & 1_2 & 0 & \cdots & 0 & 1_n & 0 \\ 0 & 0 & 1_1 & 0 & 0 & 1_2 & \cdots & 0 & 0 & 1_n \end{vmatrix}$$

$$Cov_n = \begin{bmatrix} \langle \delta r1_x \delta r1_x \rangle & \langle \delta r1_x \delta r1_y \rangle & \langle \delta r1_x \delta r_z \rangle & \cdots & \langle \delta r1_x \delta rn_x \rangle & \langle \delta r1_x \delta rn_y \rangle & \langle \delta r1_x \delta rn_z \rangle \\ \langle \delta r1_y \delta r1_x \rangle & \langle \delta r1_y \delta r1_y \rangle & \langle \delta r1_x \delta r1_x \rangle & \cdots & \langle \delta r1_y \delta rn_x \rangle & \langle \delta r1_y \delta rn_y \rangle & \langle \delta r1_y \delta rn_z \rangle \\ \langle \delta r1_z \delta r1_x \rangle & \langle \delta r1_z \delta r1_y \rangle & \langle \delta r1_z \delta r1_z \rangle & \cdots & \langle \delta r1_z \delta rn_x \rangle & \langle \delta r1_z \delta rn_y \rangle & \langle \delta r1_z \delta rn_z \rangle \\ \vdots & \vdots & \vdots & \ddots & \vdots & \vdots & \vdots \\ \langle \delta rn_x \delta r1_x \rangle & \langle \delta rn_x \delta r1_y \rangle & \langle \delta rn_x \delta r1_z \rangle & \cdots & \langle \delta rn_x \delta rn_x \rangle & \langle \delta rn_x \delta rn_y \rangle & \langle \delta rn_x \delta rn_z \rangle \\ \langle \delta rn_y \delta r1_x \rangle & \langle \delta rn_y \delta r1_y \rangle & \langle \delta rn_y \delta r1_z \rangle & \cdots & \langle \delta rn_y \delta rn_x \rangle & \langle \delta rn_y \delta rn_y \rangle & \langle \delta rn_y \delta rn_z \rangle \\ \langle \delta rn_z \delta r1_x \rangle & \langle \delta rn_z \delta r1_y \rangle & \langle \delta rn_y \delta r1_z \rangle & \cdots & \langle \delta rn_z \delta rn_x \rangle & \langle \delta rn_z \delta rn_y \rangle & \langle \delta rn_z \delta rn_z \rangle \end{bmatrix}$$

$$V = \begin{vmatrix} r_{1x} \\ r_{1y} \\ r_{1z} \\ r_{2x} \\ r_{2y} \\ r_{2z} \\ \vdots \\ r_{nx} \\ r_{ny} \\ r_{nz} \end{vmatrix} \qquad Cov_r = \begin{bmatrix} \langle \delta r_x \delta r_x \rangle & \langle \delta r_x \delta r_y \rangle & \langle \delta r_x \delta r_z \rangle \\ \langle \delta r_y \delta r_x \rangle & \langle \delta r_y \delta r_y \rangle & \langle \delta r_y \delta r_z \rangle \\ \langle \delta r_z \delta r_x \rangle & \langle \delta r_y \delta r_z \rangle & \langle \delta r_y \delta r_z \rangle \end{bmatrix}$$

r=the position of each survey point (1–n) having (x,y,z) coordinates n=the number of surveys taken.

26. The method of claim 25 wherein the resultant uncertainty is calculated from the equation:

$$Cov_{MPP} = (H_n^T Cov_n^{-1} H_n)^{-1}.$$

* * * * *